US005255001A

United States Patent [19]

Tamura et al.

[11] Patent Number: 5,255,001

[45] Date of Patent: Oct. 19, 1993

[54] ANTENNA SYSTEM FOR PORTABLE RADIO APPARATUS

[75] Inventors: Yoshiharu Tamura; Takao Ono, both of Tokyo, Japan

[73] Assignee: NEC Corporation, Tokyo, Japan

[21] Appl. No.: 627,455

[22] Filed: Dec. 14, 1990

Related U.S. Application Data

[63] Continuation-in-part of Ser. No. 573,744, Aug. 28, 1990, abandoned.

[30] Foreign Application Priority Data

Aug. 29, 1989 [JP] Japan ..... 1-223460
Dec. 14, 1989 [JP] Japan ..... 1-322586

[51] Int. Cl.[5] ..... H01Q 1/24; H01Q 1/50
[52] U.S. Cl. ..... 343/702; 343/906
[58] Field of Search ..... 343/702, 844, 893, 895, 343/906, 866; 455/351, 347, 277

[56] References Cited

U.S. PATENT DOCUMENTS 3,946,390 3/1976 Alexander et al. ..... 343/702
3,969,728 7/1976 Hodsdon et al. ..... 343/702
4,121,218 10/1978 Irwin et al. ..... 343/702
4,313,119 1/1982 Garay et al. ..... 343/702
4,806,024 8/1989 Egashira ..... 343/702
4,829,591 5/1989 Hashimoto et al. ..... 455/277
4,868,576 9/1989 Johnson, Jr. ..... 343/702
4,958,382 9/1990 Imanishi ..... 343/702

FOREIGN PATENT DOCUMENTS 0350006 10/1990 European Pat. Off. .
107903 6/1985 Japan .
220352 8/1924 United Kingdom ..... 343/702

*Primary Examiner*—Michael C. Wimer
*Assistant Examiner*—Hoanganh Le
*Attorney, Agent, or Firm*—Sughrue, Mion, Zinn, Macpeak & Seas

[57] ABSTRACT

An antenna for a portable radio apparatus has a first antenna construction connected to the casing of the apparatus and a second antenna construction affixed to a base plate or earth plate which is incorporated in the casing. The first antenna construction has a movable joint which allows the first antenna construction to move between a first position where it is regarded as forming a part of the contour of the casing and a second position where it is protruded from the contour and regarded as being located in free space. The second antenna construction corrects the matching state of the first antenna construction such that adequate antenna radiation characteristics are set up in the first position. Optimal antenna characteristics are, therefore, achievable when the first antenna construction is in any one of the first and second positions.

19 Claims, 6 Drawing Sheets

ANTENNA SYSTEM FOR PORTABLE RADIO APPARATUS

This application is a continuation-in-part of Ser. No. 07/573,744 filed on Aug. 28, 1990, now abandoned.

BACKGROUND OF THE INVENTION

The present invention relates to an antenna system and, more particularly, to an antenna system for a portable radio telephone or similar portable radio apparatus.

With a portable radio apparatus such as a portable radio telephone, it is desirable from the portability standpoint that when transmission or reception is not effected or is effected at low levels, a regular antenna be received in the casing of the apparatus to reduce the overall dimensions of the apparatus. An implementation for receiving the antenna as mentioned has been proposed in various forms in the past, as follows.

Specifically, the antenna may be bodily removed from the portable radio apparatus to allow the apparatus to be carried in a smaller configuration. In this case, however, brings about a problem that mounting and dismounting the antenna is troublesome, and a problem that the antenna physically separated from the apparatus can easily be lost. Moreover, the radio apparatus is practically unable to transmit or receive a radio signal without the antenna.

The antenna may be provided with a foldable structure to reduce the length of the radio apparatus. A drawback with the foldable antenna scheme is that, in the folded position, the radiation characteristics of the antenna are effected by a shield structure and a printed circuit board which are usually incorporated in a radio apparatus, obstructing adequate transmission and reception. In addition, the antenna exposed to the outside at all times is not desirable for cosmetic reasons.

Another implementation heretofore proposed is such that when the radio equipment is not operated or is operated at low levels, the regular antenna is retracted into the casing of the apparatus and switched to a built-in or internal antenna. This approach, however, is not practicable without resorting to two independent antennas and a switch for switching them over. This, coupled with the fact that a mechanism for interlocking the antenna switching operations is indispensable, results in the need for substantial space, impeding the miniaturization of such a radio apparatus. Further, the extra switch aggravates the high-frequency losses of signals. The radio apparatus with this antenna switching scheme would be complicated in structure and, therefore, expensive.

A telescopic antenna is another scheme for enhancing the portability of a portable radio apparatus. This type of antenna is telescoped into the casing of the apparatus when a small antenna gain suffices. A telescopic antenna, however, lacks sufficient mechanical strength since the diameter thereof is extremely small at the tip. Such an antenna also requires an extra space for its accommodation in the casing of the apparatus, thus obstructing the miniaturization of the apparatus. Further, the radiation characteristics of the antenna are critically degraded when the antenna is telescopically retracted.

Even though the portability is required, it is desirable in a portable radio apparatus that an antenna be provided with a sufficient gain with respect to a service area and be configured to allow an external amplifier, for example, to be connected thereto.

SUMMARY OF THE INVENTION

It is therefore an object of the present invention to provide an antenna for a portable radio apparatus which miniaturizes and enhances the portability of the apparatus without being removed from the apparatus.

It is another object of the present invention to provide an antenna for a portable radio apparatus which preserves desirable radiation characteristics thereof even when brought to an easy-to-carry position.

It is another object of the present invention to provide an antenna for a portable radio apparatus which has an attractive appearance.

It is yet another object of the present invention to provide an antenna system having an RF connector which is provided on a portable radio apparatus and which is connectable with any kind of antenna.

It is further object of the present invention to provide an antenna system having an RF connector which is provided on a portable radio apparatus and which is connectable with an external amplifier or the like.

An antenna system for a portable radio apparatus of the present invention has a base plate or earth plate incorporated in the casing of the apparatus, a first antenna construction having an antenna element thereinside, and a second antenna construction. The first antenna construction has a movable joint which allows it to move between a first position where it forms a part of the contour of the apparatus and a second position where it protrudes from the contour of the apparatus. When the first antenna construction is in the first position, the second antenna construction corrects the antenna radiation characteristics and matching characteristics of the antenna. The second antenna construction is affixed to the earth plate inside the casing.

BRIEF DESCRIPTION OF THE DRAWINGS

The above-mentioned and other objects, features and advantages of the present invention will become more apparent by reference to the following detailed description of the invention taken in conjunction with the accompanying drawings, wherein.

DETAILED DESCRIPTION OF THE PREFERRED EMBODIMENTS

Figure 1A:
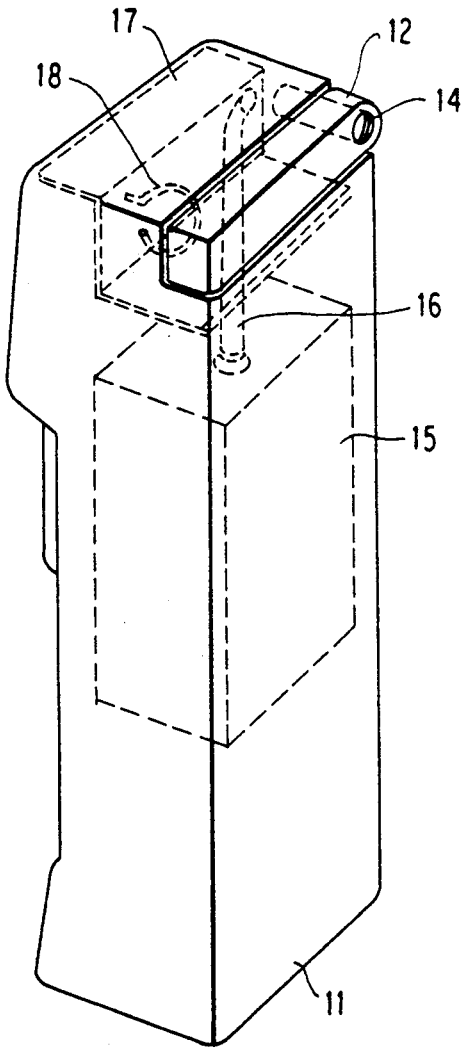
FIGS. 1(*a*) and 1(*b*) are perspective views each showing a portable radio apparatus having an antenna system according to a first embodiment of the present invention in a particular position.
Figure 1B:
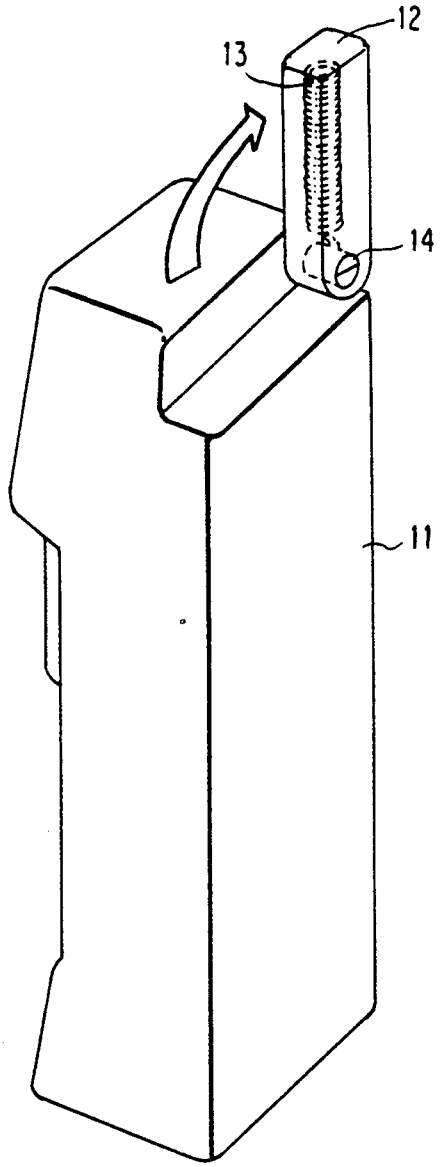

Referring to FIGS. 1(*a*) and 1(*b*) and 2, a portable radio apparatus including an antenna system embodying the present invention is shown which includes a casing 11. A first antenna construction 12 is mechanically connected to the casing 11 and constitutes a major element of the antenna of the apparatus. The first antenna construction 12 has an antenna element 13 which is the main element of an antenna reflector, and a movable joint 14 which serves as a part of the antenna reflector as well. Incorporated in the casing 11 are a transmitter-receiver 15, an antenna feeder 16 interconnecting the transmitter-receiver 15 and the movable joint 14, a base plate or ground (earth) plate 17, and a second antenna construction 18. Generally, the transmitter-receiver 15 has an antenna duplexer 19, a transmitting portion 20, a receiving portion 21, and a control portion 22 for controlling the transmitting and receiving portions 20 and 21. The radio apparatus may further include a power supply portion and a dialling unit, not shown. In this embodiment, the first antenna construction 12 is movable between two different positions, i.e., a first position where the first antenna construction 12 is formed as a part of the contour of a casing 11 (FIG. 1(*a*)) and a second position where it is protruded from the casing 11 (FIG. 1(*b*)).

As shown in FIG. 1(*a*), the first antenna construction 12 forms a part of the contour of the radio apparatus which is mainly defined by the casing 11. Assume that the antenna element 13 is positioned close to the earth plate 17 which is incorporated in the casing 11 and has ground potential as shown in FIG. 1(*a*), and that the second antenna construction 18 is absent. Then, the antenna characteristics of the radio apparatus such as the antenna gain and radiation impedance would be changed and degraded, compared to the characteristics under the condition wherein the antenna element 13 is regarded as existing in free space. The second antenna construction 18 serves to correct such antenna characteristics which would otherwise be degraded. Affixed to the earth plate 17, the second antenna construction 18 is so positioned, shaped and dimensioned as to implement adequate correction, which will be described in detail.

As shown in FIG. 1(*b*), the first antenna construction 12 may be rotated by the movable joint 14 to the second position where it protrudes from the contour of the casing 11. The joint 14 is of the type having a rotatable shaft, as well known in the art. While FIG. 1(*b*) does not show the internal arrangement of the casing 11 for clarity, it shows a specific configuration of the antenna element 13 which is disposed in the first antenna construction 12. Specifically, the antenna element 13 is provided with a hilical whip structure implemented with a metallic wire. In the second position shown in FIG. 1(*b*), the antenna element 13 and the antenna construction 18 are spaced apart from each other and, therefore, electrically sparingly coupled with each other. It follows that the antenna characteristics of the radio apparatus are substantially determined by the characteristics of the antenna element 13. In the condition shown in FIG. 1(*b*), the antenna characteristics may be determined with no regard to the characteristics of the second antenna construction 18.

Figure 2:
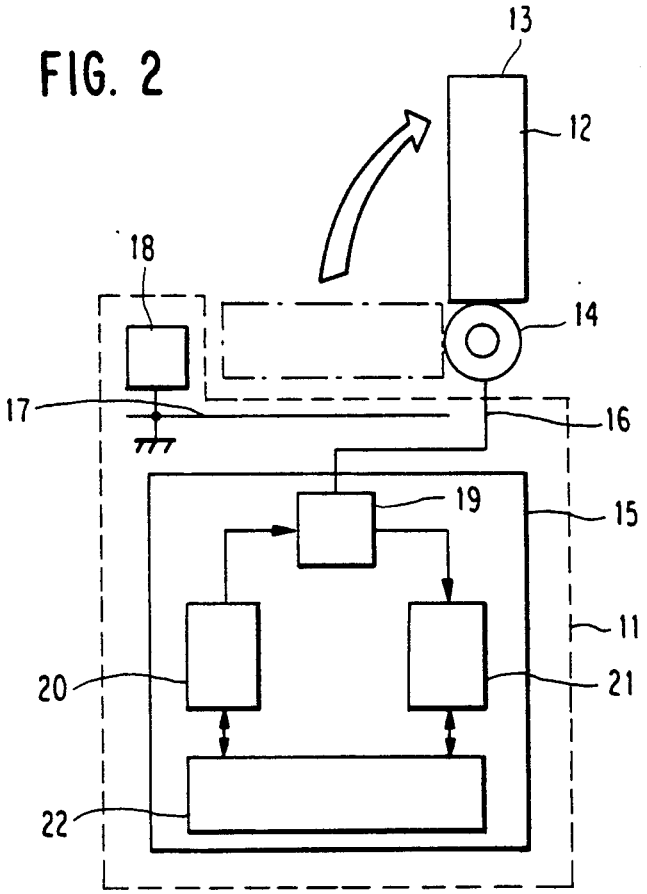
FIG. 2 is a block diagram schematically showing circuitry incorporated in the radio apparatus of FIGS. 1(*a*) and 1(*b*)
Figure 3:
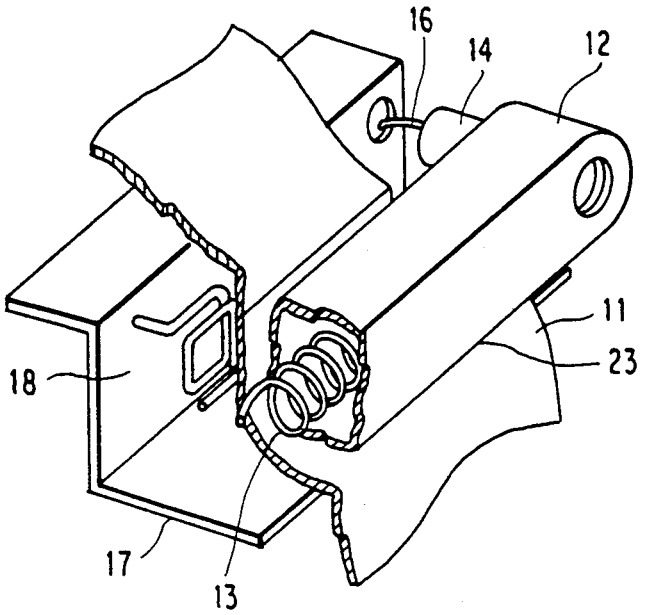
FIG. 3 is a fragmentary perspective view showing an antenna portion of the embodiment in detail.

FIG. 3 shows in detail the first and second antenna constructions 12 and 18 determining the major characteristics of the antenna, and the earth plate 17. As shown, the antenna construction has the antenna element 13 implemented with a metallic wire, a cover 23 made of a plastic or similar dielectric substance for protecting the antenna element 13, and the movable joint 14. The casing 11 made of a plastic or similar substance is so configured and positioned as to isolate the first antenna construction 12 from the earth plate 17 and the second antenna construction 18. The antenna feeder 16 is electrically connected at one end to the movable joint 14 and at the other end to the duplexer 19, FIG. 2. The movable joint 14 is made of a metal and electrically connects the antenna element and feeder 13 and 16. The movable joint 14 also mechanically fixes the casing 11 and the first antenna construction 18. The developed length of the helical antenna element 13 is substantially one-fourth of the wavelength of the frequency used. Adjustment is made such that substantially optimal antenna characteristics are set up when the first antenna construction 12 is positioned as shown in FIG. 1(*b*). It is to be noted that the influence of the casing 11 and cover 23 on the antenna characteristics is negligible so long as they have a minimum of losses and are thin. On the other hand, when the antenna construction 12 is laid down to the position shown in FIG. 1(*a*), the antenna characteristics are noticeably effected. Specifically, should the second antenna construction 18 be absent, the first antenna gain would be reduced by more than 20 dB, compared to that in free space. This may be accounted for by the radiation impedance which, as the antenna element 13 approaches the earth plate 17, decreases due to the resultant increase in the capacitance between the element 13 and the plate 17. The second antenna construction 18 comprises a metallic wire which is electrically connected to the earth plate 17 at one end thereof. The second antenna construction 18 is shaped, dimensioned and positioned in consideration of a necessary frequency and the band thereof, such that the first antenna construction 12 is adequately matched. For example, the second antenna construction 18 may be provided with a rectangular ring-like configuration and located in close proximity to the open end of the antenna element 13. This ring-like configuration is successful in reducing the distance between the earth plate 17 and the first antenna construction 12 and thereby the overall dimensions of the radio apparatus. The second antenna construction 18 may be affixed to the earth plate 17 by a fixing member made of a plastic, for example. In such a configuration, the second antenna construction 18 plays the role of an inductance element, i.e. the second antenna construction is magneto-electrically coupled to the first antenna construction and, therefore, compensates for a capacitance component ascribable to the position of the first antenna construction 12 close to the earth plate 17. It will be noted that the structure and electric characteristics of the second antenna construction 18 described above are only illustrative and may be selected in matching relation to the characteristics of the first antenna construction 12 and required antenna characteristics. Further, the earth plate 17 may be configured such that a part thereof forms a structural element of the first antenna construction 12.

Figure 4A:
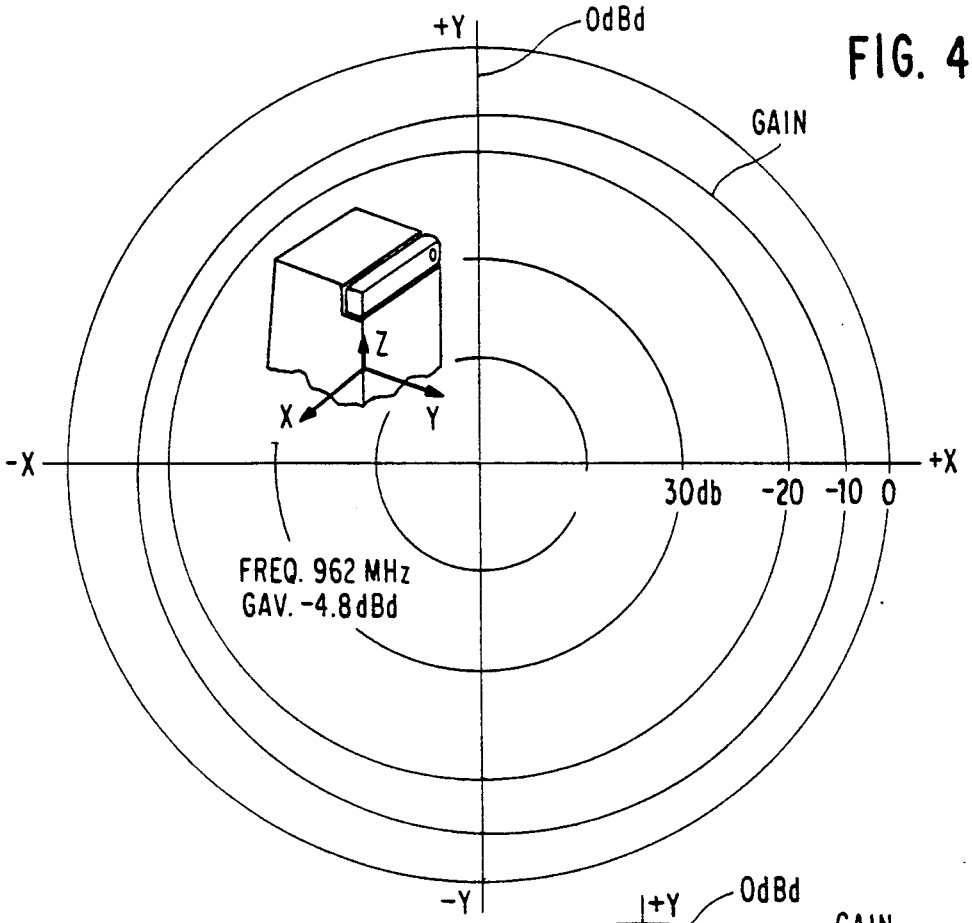
FIGS. 4(*a*) and 4(*b*) are charts representative of antenna radiation characteristics particular to the embodiment.
Figure 4B:
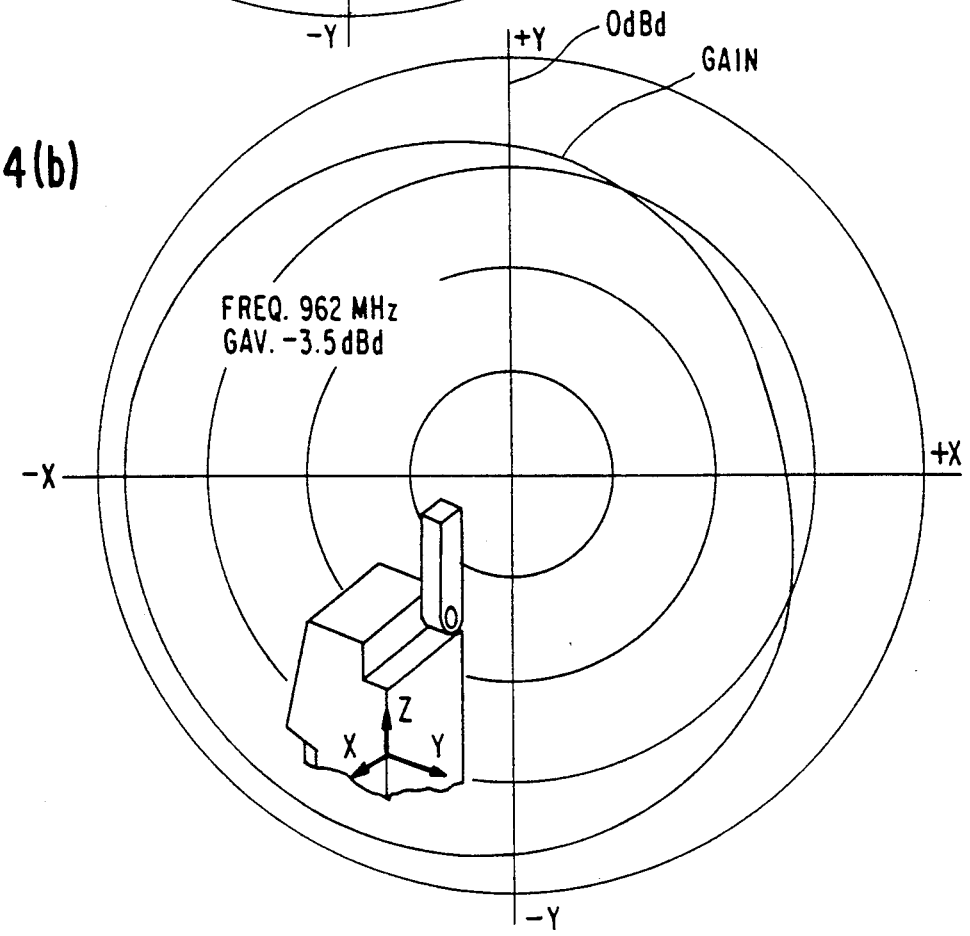

FIGS. 4(*a*) and 4(*b*) are representative of the results of specific measurements associated with the positions shown in FIGS. 1(*a*) and 1(*b*), respectively. As shown, when the frequency was 962 MHz, the average gain GaV was measured to be −4.8 dBd (dBd: antenna gain normalized by dipole antenna gain) in the position of FIG. 1(*a*) and −3.5 dBd in the position of FIG. 1(*b*). With the illustrative embodiment, therefore, it is possible to suppress the decrease in antenna gain to 1.3 dB even when the first antenna construction 12 is brought to the position where it is regarded as forming a part of the contour of the radio apparatus.

Figure 5A:
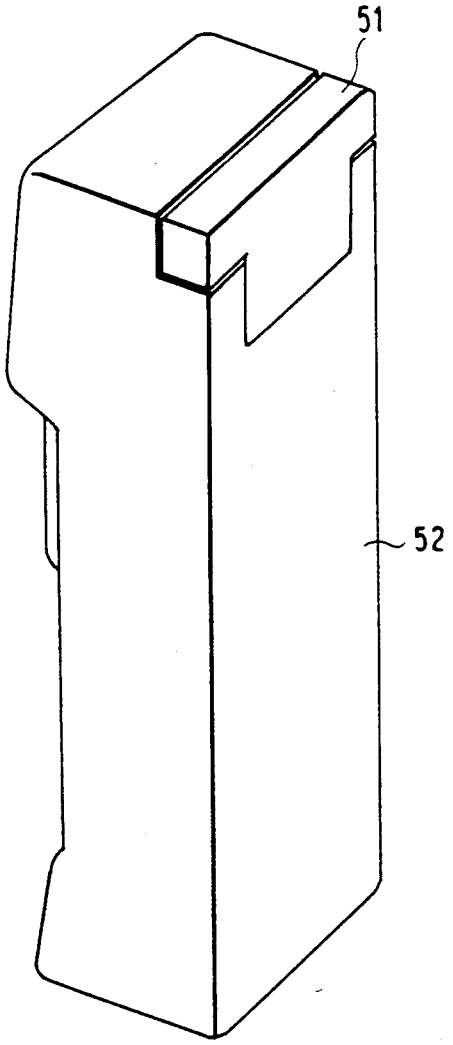
FIGS. 5(*a*) and 5(*b*) are perspective views each showing a second embodiment of the present invention in a particular position.
Figure 5B:
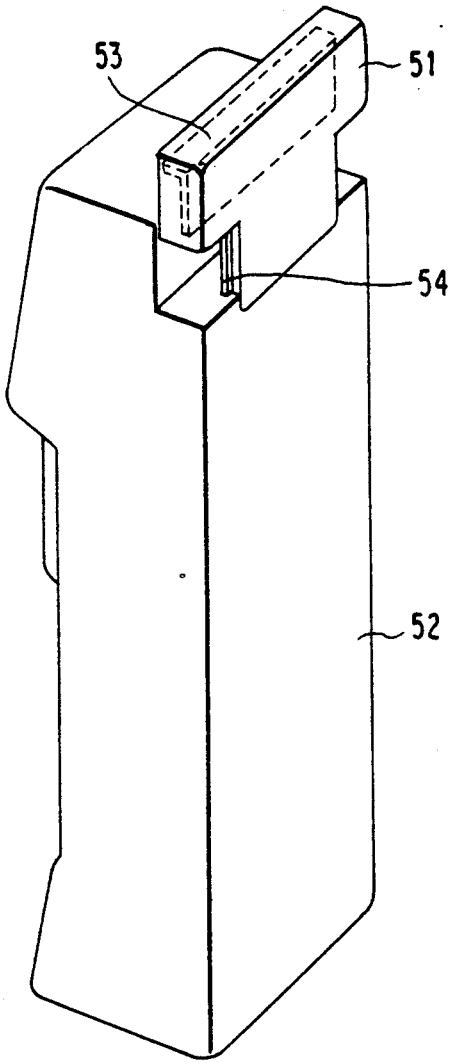

Referring to FIGS. 5(*a*) and 5(*b*), an alternative embodiment of the present invention will be described. This embodiment also has a first antenna construction 51 which is movable between two different positions, i.e., a first position where it is nested in a casing 52 (FIG. 5(*a*)) and a second position where it is protruded from the casing 52 (FIG. 5(*b*)). In the illustrative embodiment, the first antenna construction 51 has thereinside an antenna element 53 having a flat plate-like configuration. A sliding mechanism 54 which per se is conventional is used to allow the antenna construction to move between the two positions as mentioned above.

Figure 6:
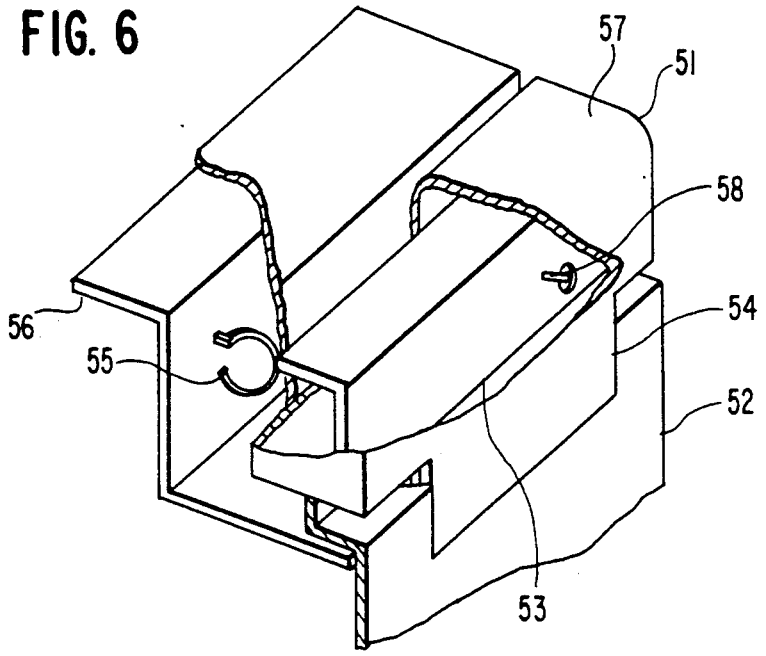
FIG. 6 is a fragmentary perspective view showing an antenna portion of the second embodiment in detail.

The first antenna construction 51 and a second antenna construction 55 which determine the major characteristics of the antenna of the radio apparatus are shown in FIG. 6 in detail, together with a base plate or earth plate 56. As shown, the antenna construction 51 has an antenna element 53, a cover 57 made of a plastic for protecting the antenna element 53, and one part of the slide mechanism 54. The casing 52 isolates the second antenna construction 55 and earth plate 56 from the first antenna construction 51. An antenna feeder 58 is connected in the neighborhood of the a side of the flat antenna element 53. The total length of the sides of the antenna element 53 is selected to be substantially one-half of the wavelength of the frequency used. The second antenna construction 55 is mechanically affixed and electrically connected to the earth plate 56 at a position which is substantially one-fourth of the wavelength as measured from the side of the antenna element 53 which is closest to the position where the antenna feeder 58 is connected. More specifically, this position corresponds to the open end of the flat antenna and allows antenna matching to be set up most easily. The second antenna construction 55, like the antenna construction 18 shown in FIG. 1, is implemented with a ring-like metallic wire which constitutes an inductance element. Again, as the antenna element 53 is moved toward the earth plate 56, the resulting capacitance component is compensated for by the second antenna construction 55. This is successful in preventing the antenna gain of the antenna of the radio equipment from being lowered.

Figure 7:
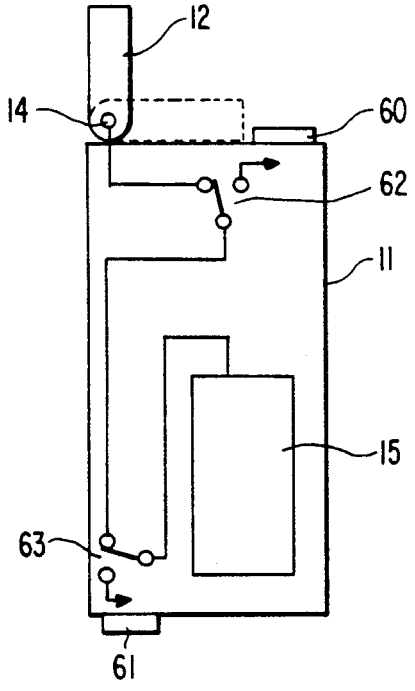
FIG. 7 is a block diagram showing a portable radio apparatus including an antenna system according to a third embodiment of this invention.

In FIG. 7, an antenna system according to a third embodiment has first and second RF connectors 60 and 61, and first and second RF switches 62 and 63 in addition to the elements included in the embodiment shown in FIG. 2. The earth plate 17 and the second antenna construction 18 shown in FIG. 2 are omitted for the sake of simplicity.

The first RF connector 60 is affixed to a part of the case 11 which is close to the first antenna construction 12 and can be connected to an external antenna. When the external antenna is connected to the first RF connector 60, the first RF switch 62 is actuated by mechanical means to cause the first RF connector 60 into connection with the second RF switch 63. When the external antenna is disconnected from the first RF connector 60, the first RF switch 62 connects the first antenna construction 12 with the second RF switch 63.

The second RF connector 61 is affixed to the bottom of the case 11 and can be connected to an external amplifier or the like. When the external amplifier is connected to the second RF connector 61, the second RF switch 63 is actuated by mechanical means to cause the second RF connector 61 into connection with the radio section 15. When the external amplifier is disconnected from the second RF connector 61, the second RF switch 63 connects the radio section 15 with the first RF switch 62.

In the condition shown in FIG. 7, for example, no component is connected to the first and second connectors 60 and 61. Hence, the radio section 15 is held in connection with the first antenna construction 12 via the RF switches 62 and 63. Accordingly, the operation of this condition is the same as that of the embodiment shown in FIG. 2.

Figure 8:
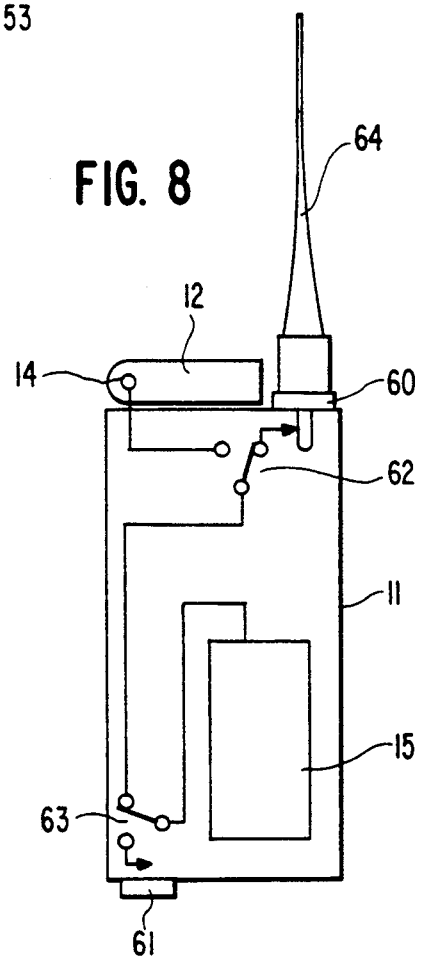
FIGS. 8 and 9 are views each showing a portable radio apparatus including the FIG. 7 embodiment in a particular operating condition.

FIG. 8 shows a condition wherein a high gain external antenna 64 is connected to the first RF connector 60. Connecting the external antenna 64 to the connector 60 and no component to the second RF connector 63 causes the RF switches 62 and 63 to connect the external antenna 64 to the radio section 15.

Figure 9:
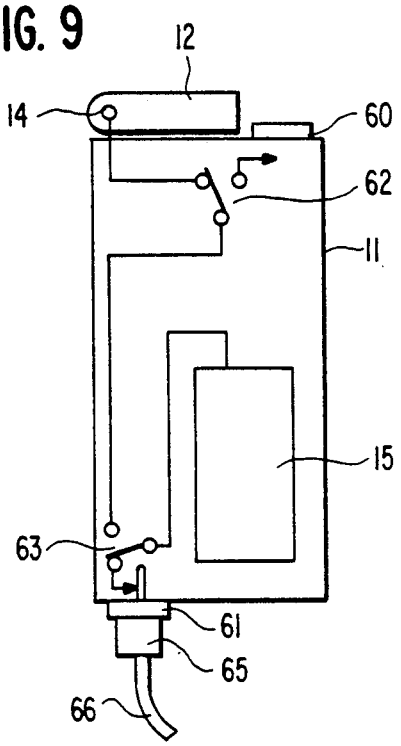

FIG. 9 shows a condition wherein an external connector 65 is connected to the second RF connector 61. The external connector 65 is also connected to the external amplifier or a booster via a lead 66. Connecting the external connector 65 to the connector 61 causes the second RF switch 63 to connect the external amplifier to the radio section 15.

The illustrative embodiment with the above construction allows any desired external antenna or the like to be mounted thereon. When an external antenna is mounted, it automatically operates the switch and thereby frees the user from troublesome operations otherwise needed to remove the second antenna construction 18.

Figure 10:
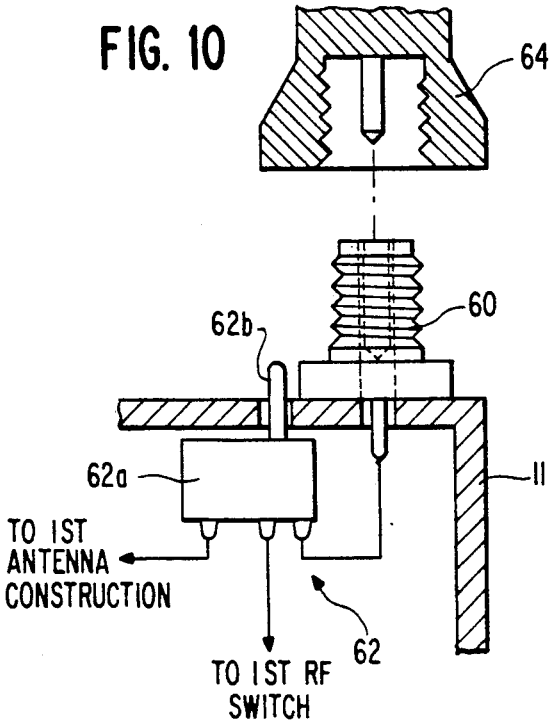
FIGS. 10 and 11A and 11B are enlarged sections each showing a particular configuration of an RF switch, used in the antenna system shown in FIGS. 7-9.
Figure 11A:
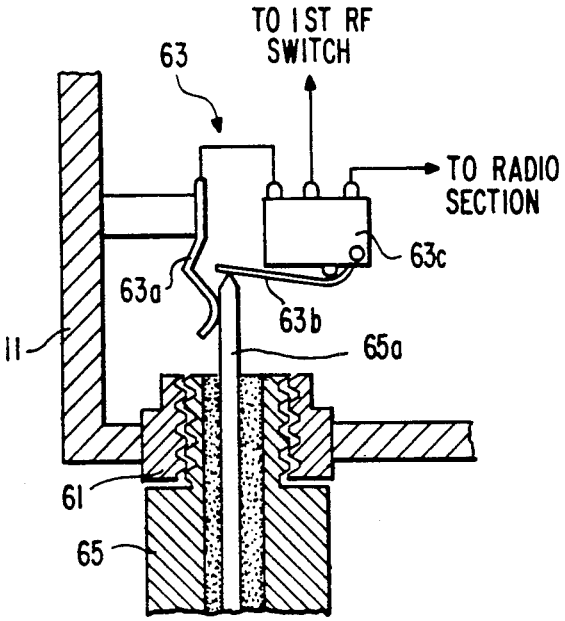
Figure 11B:
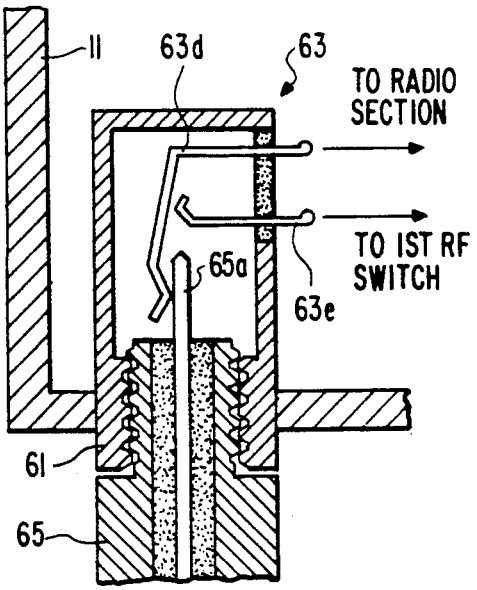

Referring to FIGS. 10 and 11A and 11B, specific configurations of the RF switches 62 and 63 will be described.

FIG. 10 shows a specific configuration of the first RF switch 62. As shown, a microswitch 62*a* having a transfer contact is disposed in the case 11 in close proximity to the first RF connector 60. A switch knob 62*b* protruding from the microswitch 62*a* extends throughout the case 11 to a position where it faces the first RF connector 60. When the external antenna 64 is connected to the first RF connector 60, the antenna 64 will actuate the switch knob 62*b* with the lower end thereof to thereby operate the microswitch 62*a*.

FIG. 11A shows a specific configuration of the second RF switch 63. In the figure, a microswitch 63*c* is located above the second RF connector 61 within the case 11. The external connector 65 which may be connected to the second RF connector 61 has a center conductor 65*a*. When the external connector 65 is connected to the second RF connector 61, the center conductor 65 urges a tongue 63*b* affixed to the microswitch 63*c* while making contact with a contact 63*a*. The tongue 63*b* in turn operates the microswitch 63*c*.

FIG. 11B shows another specific configuration of the second RF switch 63. As shown, the second RF switch 63 has two contacts 63*e* and 63*d* thereinside which are normally held in contact with each other. When the external connector 65 is connected to the second RF connector 61, the center conductor 65*a* of the external connector 65 urges or deforms the contact in the lateral direction away from the contact 63*e*. As a result, the contact 63*d* is caused into contact with the external connector 65 and out of contact with the contact 63*e*.

Of course, any of the constructions shown in FIGS. 10, 11A and 11B are applicable to both of the first and second RF switches 62 and 63.

In the illustrative embodiment, the operation of the RF switch 62 or 63 is mechanically interlocked with the connection to the RF connector 60 or 61. If desired, it may be effected electrically by use of a diode switch circuit, for example.

The third embodiment of the present invention provides a portable radio apparatus or telephone in which an external antenna or an external connector is connected to a first or a second RF connector, an RF switch associated therewith is automatically operated to selectively connect a transmitter-receiver to the antenna or the connector. The telephone, therefore, is operable with any one of a standard antenna mounted thereon and optional antennas and can be readily connected to an external apparatus. When any external antenna is used with the telephone, it is not necessary for the standard antenna to be removed. This is successful in promoting easy handling of the telephone. Furthermore, the telephone allows a high performance antenna adapted for use in weak-field areas to be mounted thereon through an RF connector.

Although the invention has been described with reference to specific embodiments, this description is not meant to be construed in a limiting sense. Various modification of the disclosed embodiments, as well as other embodiments of the invention, will become apparent to persons skilled in the art upon reference to the description of the invention. It is therefore contemplated that the appended claims will cover any modifications or embodiments as fall within the true scope of the invention.

What is claimed is:

1. An antenna system for a portable radio apparatus, comprising:

an earth plate mounted in a casing of the radio apparatus;

a first antenna construction comprising an antenna element accommodated therein, and a movable joint for allowing said first antenna construction to move between a first position where said first antenna construction forms a part of a contour of said casing and a second position where said first antenna construction protrudes from said contour; and a second antenna construction affixed to said earth plate inside the casing and magneto-electrically coupled to said first antenna construction to constitute a single antenna together with said first antenna construction at least when said first antenna construction is in said first position, said second antenna construction correcting an antenna radiation characteristic of said first antenna construction when said first antenna construction is in said first position.

2. An antenna system as claimed in claim 1, wherein said second antenna construction is provided on said earth plate which, when said first antenna construction is in said first position, is located in close proximity to an open end of said antenna element.

3. An antenna system as claimed in claim 1, wherein said antenna element comprises a helical whip type antenna element.

4. An antenna system as claimed in claim 1, wherein said antenna element comprises a flat plate-like antenna element.

5. An antenna system as claimed in claim 1, wherein said second antenna construction comprises a ring-like metal wire.

6. An antenna system as claimed in claim 1, wherein said movable joint allows said first antenna construction to rotate about one end of said first antenna construction.

7. An antenna system as claimed in claim 1, wherein said movable joint allows said first antenna construction to slide on the casing.

8. An antenna system as claimed in claim 1, wherein said second antenna is in a fixed position.

9. An antenna system as claimed in claim 1, wherein said second antenna does not extend beyond said contour of said casing.

10. A portable radio apparatus comprising:

a casing mounting a transmitting portion and a receiving portion therein;

an earth plate disposed in said casing;

a first antenna construction comprising an antenna element mounted therein, and a movable joint for allowing said first antenna construction to move between a first position where said first antenna construction forms a part of a contour of said casing and a second position where said first antenna construction protrudes from said contour;

a second antenna construction affixed to said earth plate inside the casing and magneto-electrically coupled to said first antenna construction to constitute a single antenna together with said first antenna construction at least when said first antenna construction is in said first position, said second antenna construction correcting an antenna radiation characteristic of said first antenna construction when said first antenna construction is in said first position; and said first antenna construction being connected to said transmitting portion and said receiving portion via a duplexer.

11. An antenna system as claimed in claim 10, wherein said second antenna is in a fixed position.

12. An antenna system as claimed in claim 10, wherein said second antenna does not extend beyond said contour of said casing.

13. An antenna system for a radio apparatus, comprising:

an earth plate mounted in a casing of said apparatus;

a main antenna element movable between first and second positions where said main antenna element forms a part of a contour of said casing and said main antenna element protrudes from said contour, respectively; and correcting means affixed to said earth plate inside the casing and magneto-electrically coupled to said main antenna element to constitute a single antenna together with said main antenna element at least when said main antenna element is in said first position, said correcting means correcting an antenna radiation characteristic of said main antenna element when said main antenna element is in said first position.

14. An antenna system as claimed in claim 13, wherein said correcting means is in a fixed position.

15. An antenna system as claimed in claim 13, wherein said correcting means does not extend beyond said contour of said casing.

16. An antenna system for a portable radio apparatus, comprising:

a regular antenna mounted on said portable radio apparatus;

a radio section mounted on said portable radio apparatus; and connecting means mounted on said portable radio apparatus and connected to said regular antenna and said radio section and having first and second connectors electrically and mechanically connectable to an external antenna and an external apparatus, respectively, for electrically connecting said regular antenna to said radio section when said external antenna is not connected to said first connector and said external apparatus is not connected to said second connector, for electrically connecting said external antenna to said radio section when said external antenna and no external apparatus are connected to said first and second connectors, respectively, and for electrically connecting said external apparatus to said radio section when said second connector is connected to said external apparatus.

17. An antenna system as claimed in claim 16, wherein said regular antenna comprises:

an earth plate mounted in a casing of said apparatus;

a main antenna construction comprising an antenna element accommodated therein, and a movable joint for allowing said main antenna construction to move between a first position where said main antenna construction forms a part of a contour of said casing and a second position where said main antenna construction protrudes from said contour; and correcting means affixed to said earth plate inside the casing and magneto-electrically coupled to said main antenna construction to constitute a single antenna together with said main antenna construction, said correcting means correcting an antenna radiation characteristic of said main antenna construction when said main antenna construction is in said first position.

18. An antenna system as claimed in claim 17, wherein said external apparatus comprises a booster.

19. An antenna system as claimed in claim 17, wherein said connecting means includes first and second radio frequency (RF) switches each comprising a microswitch.

* * * * *